US006079545A

United States Patent [19]

Dombek

[11] Patent Number: 6,079,545

[45] Date of Patent: Jun. 27, 2000

[54] APPARATUS FOR VARYING THE DISTANCES BETWEEN THE ENDS OF ROD-SHAPED ARTICLES OF THE TOBACCO PROCESSING INDUSTRY

[75] Inventor: Manfred Dombek, Dassendorf, Germany

[73] Assignee: Hauni Maschinenbau AG, Germany

[21] Appl. No.: 09/022,925

[22] Filed: Feb. 12, 1998

[30] Foreign Application Priority Data

Mar. 5, 1997 [DE] Germany ..... 197 08 836

[51] Int. Cl.[7] ..... B65G 47/26

[52] U.S. Cl. ..... 198/458; 198/456

[58] Field of Search ..... 198/456, 457.01, 198/457.03, 458

[56] References Cited

U.S. PATENT DOCUMENTS

| | | | |
|---|---|---|---|
| 2,090,598 | 8/1937 | Parsons | 198/458 |
| 2,124,397 | 7/1938 | Gwinn et al. | 198/24 |
| 2,162,424 | 6/1939 | Edwards | 131/39 |
| 2,439,657 | 4/1948 | Hexter et al. | 198/458 |
| 2,484,222 | 10/1949 | Hauswald | 198/458 |
| 2,781,886 | 2/1957 | Stelzer | 198/33 |
| 3,372,702 | 3/1968 | Bohn et al. | 198/458 X |
| 4,087,001 | 5/1978 | Daisley | 198/456 |

FOREIGN PATENT DOCUMENTS

| | | | |
|---|---|---|---|
| 917558 | 3/1959 | United Kingdom . | |
| 929961 | 6/1963 | United Kingdom . | |
| 1082085 | 9/1967 | United Kingdom . | |
| 1302783 | 1/1973 | United Kingdom | 198/458 |

*Primary Examiner*—James R. Bidwell

*Attorney, Agent, or Firm*—Venable; George H. Spencer; Robert Kinberg

[57] ABSTRACT

The spacing between the neighboring ends of successive pairs of coaxial plain cigarettes of unit length is changed during sidewise transport by two endless belt conveyors which diverge or converge relative to the direction of advancement of the pairs of cigarettes, namely at right angles to the common longitudinal axes of the pairs of cigarettes. If the spacing is to be increased, for example to provide room for filter plugs of double unit length in a filter tipping machine, the extent of axial movement of the cigarettes of each pair can be limited by lateral conveyors which flank, and are driven at the same speed as and at right angles to the axes of, the pairs of cigarettes approaching the station where the cigarettes are removed from the conveyors.

19 Claims, 3 Drawing Sheets

APPARATUS FOR VARYING THE DISTANCES BETWEEN THE ENDS OF ROD-SHAPED ARTICLES OF THE TOBACCO PROCESSING INDUSTRY

BACKGROUND OF THE INVENTION

The invention relates to improvements in apparatus for manipulating cigarettes or other elongated rod-shaped articles of the tobacco processing industry. More particularly, the invention relates to improvements in apparatus for changing the distances or spacing or clearances between neighboring ends of coaxial rod-shaped articles of the tobacco processing industry. Still more particularly, the invention relates to improvements in apparatus for changing (increasing or reducing) the spacing between neighboring ends of successive pairs of coaxial rod-shaped articles (hereinafter called cigarettes for short) of the tobacco processing industry while the pairs of coaxial cigarettes are moved sideways, i.e., at least substantially at right angles to their longitudinal axes.

Apparatus of the above outlined character can be utilized in filter tipping machines of the type wherein plain cigarettes of multiple (normally double) unit length issuing from a cigarette rod making machine are caused to form a series or row of successive cigarettes wherein the cigarettes move sideways. For example, successive cigarettes of double unit length are severed midway between their ends to yield a series of successive pairs of coaxial plain cigarettes of unit length. The neighboring ends of plain cigarettes of successive pairs must be moved axially and away from each other (e.g., by pneumatic means) in order to establish clearances or gaps each having a length at least matching or exceeding the length of a filter mouthpiece or filter plug of double unit length. Such filter plugs of double unit length are inserted between the neighboring ends of successive pairs of spaced-apart coaxial plain cigaretets of unit length, the cigarettes of each pair are thereupon moved axially toward each other to abut the adjacent ends of the filter plug of double unit length between them, and the thus obtained groups of three coaxial rod-shaped articles (namely two spaced-apart plain cigarettes of unit length and a filter plug of double unit length between them) are then wrapped into adhesive-coated blanks of cigarette paper, artificial cork or other suitable tipping paper to form filter cigarettes of double unit length. Successive filter cigarettes of double unit length are moved sideways and severed across their filter tips of double unit length to yield pairs of filter cigarettes of unit length which are thereupon processed (such as tested for potential defects, e.g., holes in their wrappers, soft tobacco-containing ends and/or others, and packed) in the customary way.

Heretofore known methods and apparatus for varying spacings between the neighboring ends of successive pairs of plain cigarettes or other elongated rod-shaped articles of the tobacco processing industry are not entirely satisfactory, especially when such methods are employed and such apparatus are utilized in connection with the making of filter cigarettes in modern high-speed filter tipping machines.

OBJECTS OF THE INVENTION

An object of the invention is to provide a novel and improved method of varying the spacing between neighboring ends of successive pairs of coaxial rod-shaped articles (such as plain cigarettes of unit length) of the tobacco processing industry.

Another object of the invention is to provide a novel and improved apparatus for the practice of the above outlined method.

A further object of the invention is to provide an apparatus which treats the rod-shaped articles gently, even if such articles are processed in modern high-speed production lines, such as combinations of cigarette rod making, filter tipping and packing machines.

An additional object of the invention is to provide a relatively simple, compact and reliable apparatus which can be utilized with advantage in filter tipping and analogous machines for the making of filter cigarettes, cigars, cigarillos or cheroots.

Still another object of the invention is to provide novel and improved combinations of conveyors, or conveyors, severing means and article holding means, which can be utilized with advantage in the above outlined apparatus.

A further object of the invention is to provide a filter tipping machine which embodies the above outlined apparatus for the manipulation of plain and filter cigarettes as well as rod-shaped filters fo tobacco smoke.

Another object of the invention is to provide an apparatus which is constructed and assembled in such a way that the rod-shaped articles which are being manipulated therein are not required to abruptly change the direction of their advancement to an extent which could adversely influence their positions relative to each other.

SUMMARY OF THE INVENTION

One feature of the invention resides in the provision of an apparatus for manipulating pairs of coaxial elongated rod-shaped articles (such as plain cigarettes of unit length) of the tobacco processing industry, and more particularly for manipulating pairs of coaxial elongated rod-shaped articles having neighboring ends. The improved apparatus comprises means for advancing successive pairs of a series of pairs of coaxial articles sideways in a predetermined direction at least substantially at right angles to their common axes. The advancing means comprises means for changing the spacing between the neighboring ends of successive pairs of the series of the pairs of coaxial articles during advancement of the pairs of articles in the predetermined direction.

The advancing means, and more particularly the means for altering the spacing between the neighboring ends of successive pairs of coaxial articles, preferably comprises or constitutes means for moving successive pairs of the series of pairs of articles along a predetermined path, e.g., in a horizontal or substantially horizontal plane.

The advancing means can comprise two endless conveyors having substantially coplanar portions which define the predetermined path. The aforementioned portions of the endless conveyors are inclined relative to each other in opposite directions relative to the predetermined direction. If such portions of the endless conveyors diverge in the predetermined direction, the spacing between the neighboring ends of successive pairs of articles is increased. On the other hand, if the aforementioned portions of the conveyors converge in the predetermined direction, the neighboring ends of successive pairs of articles are being moved nearer to each other.

The conveyors or the advancing means are preferably provided with receptacles (such as elongated flutes) for the respective articles of successive pairs of the series of pairs of articles. The receptacles of each of the two conveyors are parallel to each other and to the receptacles of the other conveyor.

As already mentioned hereinabove, the aforementioned portions of the two conveyors of the advancing means can diverge (as seen in the predetermined direction) if the spacing between the neighboring ends of successive pairs of the series of pairs of coaxial articles is to increase as a result of the advancement of articles in the predetermined direction. Such apparatus can further comprise means for limiting the extent of spacing between the neighboring ends of successive pairs of the series of pairs of coaxial articles. For example, the limiting means can comprise a pair of endless flexible conveyors (such as belts, bands or chains) which are arranged to advance in the predetermined direction in synchronism with the aforementioned conveyors forming part of the advancing means. The endless flexible conveyors of the limiting means flank the aforementioned portions of the conveyors of the article advancing means. If the predetermined path is an at least substantially horizontal path, the endless flexible conveyors of the limiting means can include at least substantially vertical article-contacting portions which flank the conveyors of the advancing means and can cause the articles to move axially with reference to the respective conveyors of the advancing means.

At least one conveyor of the limiting means is or can be adjustable relative to the advancing means, preferably transversely of the predetermined direction (i.e., in the axial direction of the articles) to thus select the maximum or minimum (or an intermediate) distance between the neighboring ends of pairs of articles advancing between the conveyors of the limiting means. Such adjustability greatly enhances the versatility of the improved apparatus.

The conveyors of the article advancing means can include or constitute endless flexible conveyors (such as chains, belts or bands) having upper and lower reaches. In accordance with one presently preferred embodiment of the improved apparatus, the upper reaches constitute the path-defining portions of the respective conveyors of the advancing means, and the articles are arranged to overlie the respective upper reaches during advancement in the predetermined direction.

Alternatively, the path defining portions can be constituted by or can include the lower reaches of the endless flexible conveyors of the advancing means, and such lower reaches are then arranged to overlie the respective articles during advancement of articles along the predetermined path. Such conveyors of the advancing means can include (or can cooperate with) means for attracting articles to the lower reaches of the respective conveyors.

The apparatus preferably further comprises means for supplying a series of successive elongated rod-shaped commodities to the advancing means along a second path (such second path can constitute an extension of the predetermined path or vice versa). Each commodity can be subdivided (such as halved) into a pair of coaxial rod-shaped articles, and such apparatus can further comprise means (e.g., a rotary circular knife) for subdividing successive commodities of the series of commodities into pairs of coaxial rod-shaped articles not later than upon arrival of successive commodities at the predetermined path.

The supplying means can comprise an endless flexible conveyor which is arranged to advance in the predetermined direction at a predetermined speed. Such apparatus can further comprise means for form-lockingly holding the commodities on the conveyor of the supplying means, at least during subdividing of the commodities. The holding means can include at least one endless conveyor which is arranged to move in synchronism with the conveyor of the supplying means.

The conveyor of the supplying means can be provided with receptacles for the advancement of commodities in the predetermined direction, and such apparatus can further comprise means for moving successive commodities of the series of commodities at least partially out of the respective receptacles during conversion of such commodities into pairs of coaxial articles as a result of the action of the subdividing means. The receptacles of the conveyor forming part of the supplying means can include or constitute flutes, and the means for moving successive commodities out of the flutes can comprise a rotary drum which is arranged to lift the commodities at least partially out of the respective flutes.

The novel features which are considered as characteristic of the invention are set forth in particular in the appended claims. The improved apparatus itself, however, both as to its construction and the method of utilizing the same, together with numerous additional important and advantageous features and attributes thereof, will be best understood upon perusal of the following detailed description of certain presently preferred specific embodiments with reference to the accompanying drawings.

DESCRIPTION OF PREFERRED EMBODIMENTS

Figure 1:
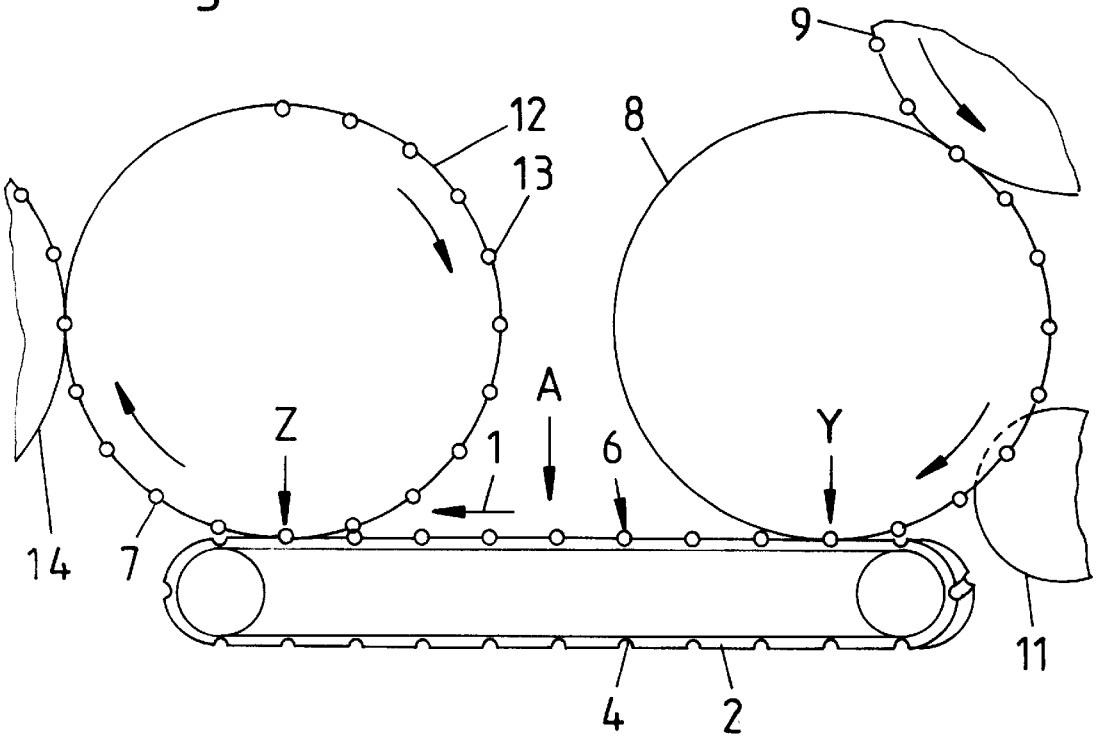
FIG. 1 is a side elevational view of an apparatus which embodies one form of the invention and is installed in a filter tipping machine, the means for limiting the extent of axial movement of the articles of successive pairs of articles relative to each other being omitted for the sake of clarity.
Figure 2:
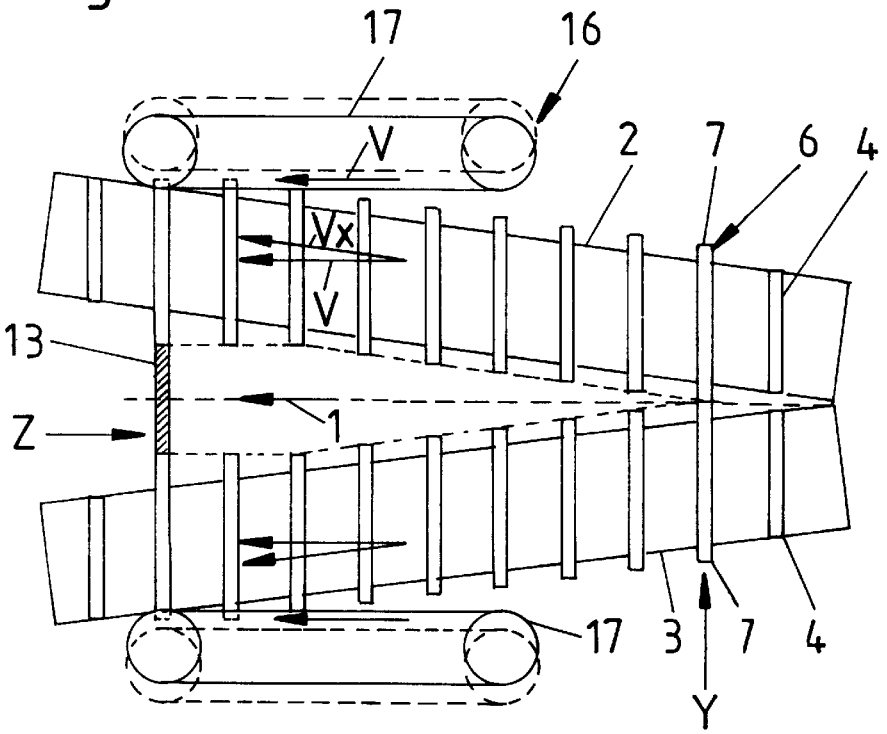
FIG. 2 is a top plan view of the apparatus substantially as seen in the direction of arrow A in FIG. 1 and further shows adjustable limiting means.

FIGS. 1 and 2 show an apparatus which is designed to increase the spacing between the neighboring ends of successive pairs 6 of coaxial rod-shaped articles 7, such as plain cigarettes of unit length. The improved apparatus comprises means for advancing successive pairs 6 of coaxial articles 7 in a predetermined direction (arrow 1), namely at right angles to the common longitudinal axes of the articles 7 in each pair 6. The advancing means comprises two endless flexible belt, band or chain conveyors 2, 3 serving to advance the respective articles 7 of each pair 6 in directions (see FIG. 2) which diverge with reference to the direction indicated by the arrow 1. This causes a gradual increase of the spacing between the neighboring ends of the articles 7 in each of the successive pairs 6 advancing in a plane above the upper reaches or stretches of the conveyors 2 and 3.

The conveyors 2, 3 are provided with receptacles in the form of flutes 4 which are parallel to each other and extend at right angles to the predetermined direction (arrow 1). The flutes 4 of the conveyor 2 are parallel to each other and the flutes 4 of the conveyor 3. Each flute 4 of the conveyor 2 is aligned with one of the flutes 4 in the conveyor 3.

The means for supplying a series of successive pairs 6 of articles 7 to successive flutes 4 of the conveyors 2, 3 at a transfer station Y comprises a first rotary drum-shaped conveyor 9 which can receive elongated commodities (such as plain cigarettes of double unit length) from a suitable cigarette rod making machine, such as that known as PROTOS and being distributed by the assignee of the present application. The conveyor 9 has axially parallel peripheral flutes which deliver commodities into successive flutes of a second drum-shaped conveyor 8 forming part of a severing or subdividing unit further including a rotary circular disc-shaped knife 11. The knife 11 severs successive commodities midway between their ends to thus form a series of pairs 6 of parallel rod-shaped articles 7 of unit length, and such pairs are delivered into successive oncoming flutes 4 of the conveyors 2 and 3.

The conveyors 2, 3 deliver pairs 6 of articles 7 to a station Z where the pairs 6 (with a prescribed spacing between the neighboring ends of the respective articles 7) are taken over by a rotary drum-shaped conveyor 12 having axially parallel peripheral flutes each of which already contains (not later than upon arrival at the station Z) a filter mouthpiece or filter plug 13 of double unit length (it is assumed here that the articles 7 are plain cigarettes of unit length). The filter plugs 13 are attracted to the conveyor 12 by suction (or are held in their flutes in any other suitable way), and suction can also be relied upon to lift successive pairs 6 of coaxial but adequately spaced apart plain cigarettes 7 of unit length out of the respective flutes 4 in the upper reaches of the conveyors 2 and 3. Thus, each of those flutes of the conveyor 12 which advance (clockwise, as viewed in FIG. 1) beyond the station Z contains a group of three coaxial rod-shaped components including a centrally located filter plug 13 of double unit length and two plain cigarettes 7 of unit length flanking the filter plug of double unit length.

The conveyor 12 delivers successive groups of components 7, 13, 7 into successive axially parallel peripheral flutes of a next-following drum-shaped conveyor 14 which can form part of a filter tipping machine (such as that known as MAX and distributed by the assignee of the present application) wherein the filter plugs 13 are sealingly secured to the adjacent end portions of the respective pairs of plain cigarettes 7 by customary adhesive-coated uniting bands of cigarette paper or other suitable tipping material. The thus obtained filter cigarettes of double unit length are severed midway between their ends (i.e., midway across the convoluted (tubular) uniting bands) to yield pairs of filter cigarettes of unit length. Such filter cigarettes can be transported to storage or directly to a suitable packing machine (e.g., a machine known as COMPAS and distributed by the assignee of the present application).

The apparatus of FIGS. 1 and 2 further comprises means for limiting the extent of axial movement of neighboring end portions of coaxial cigarettes 7 away from each other. The extent of axial movement is limited to the establishment of a spacing which invariably suffices to permit the entry of a filter plug 13 of double unit length between a pair 6 of axially spaced-apart coaxial cigarettes 7 at the station Z. The limiting means which is shown in FIG. 2 comprises two endless belt, chain or band conveyors 17 which are driven in synchronism with the conveyors 2 and 3, i.e., so that their vertical cigarette-contacting stretches advance in the same direction as (arrow 1) and at the exact speed of the cigarettes 7 in the flutes 4 of the upper stretches or reaches of the respective conveyors 2, 3. The conveyors 17 of the limiting means flank those portions of the upper reaches or stretches of the adjacent conveyors 2, 3 which advance toward and past the station Z.

The reference character 16 denotes in FIG. 2 an adjusting apparatus which serves to move the adjacent limiting conveyor 17 to any one of a plurality of different positions at selected distances from a central vertical symmetry plane between the conveyors 2 and 3. The adjusting means 16 is preferably designed to move the respective limiting conveyor 17 at right angles to the direction which is indicated by the arrow 1, i.e., in the axial direction of the cigarettes 7 at the station Z.

It goes without saying that each of the two limiting conveyors 17 can be combined with a suitable adjusting unit 16.

Those stretches of the coveyors 17 which are adjacent the respective conveyors 2, 3 serve as mobile abutments for the adjacent outer ends of the cigarettes 7, and their positions (namely the distances from the aforementioned central vertical symmetry plane between the conveyors 2 and 3) are selected with a view to ensure that the distance between the neighboring ends of pairs of plain cigarettes 7 arriving at the station Z suffices to receive filter plugs 13 of double unit length. If desired or necessary, the groups of rod-shaped articles 7, 13, 7 advancing beyond the station Z can be caused to advance between one or more pairs of convergent cams or conveyors which serve to ensure that the inner ends of the cigarettes 7 actually abut the adjacent ends of the respective filter plug 13 before such filter plug is secured to the corresponding cigarettes of unit length.

The operation of the apparatus which is shown in FIGS. 1 and 2 is as follows:

The knife 11 severs successive commodities supplied by the conveyors 9 and 8 so that each such commodity yields a pair 6 of coaxial articles (plain cigarettes) 7 of unit length. The speed at which the drum-shaped conveyor 8 delivers successive pairs 6 to the station Y is preferably the same as the speed V of the upper reaches of the conveyors 2, 3 in the direction of the arrow 1. This ensures a predictable transfer of successive pairs 6 from successive flutes of the conveyor 8 into the oncoming flutes 4 of the conveyors 2, 3.

The speed Vx of movement of the divergent upper stretches or reaches of the conveyors 2 and 3 exceeds the speed V because this ensures that the speed of movement of the flutes 4 in the direction of the arrow 1 equals V. The difference between the speeds V and Vx depends upon the inclination of the upper reaches of the conveyors 2, 3 relative to the central vertical symmetry plane between the conveyors 2 and 3.

The peripheral speed of the conveyor 12 matches the speed V of flutes in the peripheries of the supplying and severing conveyors 9, 8.

The axial movements of neighboring ends of pairs 6 of cigarettes 7 on the upper reaches of the conveyors 2, 3 are terminated when the outer ends of the cigarettes 7 are brought into contact with the adjacent vertical portions or stretches of the limiting conveyors 17. Once the cigarettes 7 abut the respective conveyors 17, they begin to move axially relative to the respective flutes 4 all the way to the station Z where they are taken over by the conveyor 12 and are caused to flank one of the filter plugs 13 of double unit length.

The cigarettes 7 of each pair 6 are moved axially toward each other if the direction of advancement of the conveyors 2, 3 is reversed, if such pairs are delivered to the conveyors 2, 3 at the station Z, and if the altered pairs 6 (with their cigarettes 7 nearer to each other) are removed from the conveyors 2, 3 at the station Y.

The provision of flutes 4 in the conveyors 2, 3 renders it possible to ensure the establishment of reliable form-locking connections between the advancing conveyor and the articles 7 during advancement of such articles from the station Y to the station Z. Nevertheless, such form-locking engagement does not prevent the conveyors 17 from moving the articles 7 on the upper reaches of the conveyors 2, 3 axially and toward each other when the spacing between the pairs 6 of coaxial articles suffices to ensure reception of a filter plug 13 of double unit length.

The provision of the adjusting means 16 for the limiting conveyors 17 enhances the versatility of the improved method and apparatus because it is possible to select the distance between the article-contacting portions or reaches of the limiting conveyors 17 in dependency upon the desired axial length of filter mouthpieces or filter plugs 13 and upon the desired axial length of discrete articles 7.

The apparatus of FIGS. 1 and 2 can be further provided with means for pneumatically attracting the articles 7 to the surfaces bounding the flutes 4 in the upper reaches of the conveyors. Such attracting means can include suction chambers beneath the upper reaches of the conveyors 2, 3 and suction ports extending from the flutes 4 to the inner sides of the respective conveyors 2, 3 and communicating with the corresponding suction chambers during advancement from the station Y to the station Z. The limiting conveyors 17 are then called upon to overcome the attraction of external surfaces of the articles 7 to the surfaces bounding the respective flutes when the width or spacing between the neighboring ends of pairs 6 of aligned articles 7 reaches the required value.

An important advantage of the improved apparatus is that the articles 7 of successive pairs can be moved axially relative to each other with a high degree of reliability even if the conveyors 9, 8, 2, 3 12 and 14 are utilized in high-speed filter tipping or other tobacco processing machines. The reason is that the articles 7 are not called upon to change the direction of their movement all the way from the conveyor 9 to the conveyor 14; all they are called upon to do is to move axially half the distance which is required between successive pairs 6 of articles 7 at the station Z.

Figure 3:
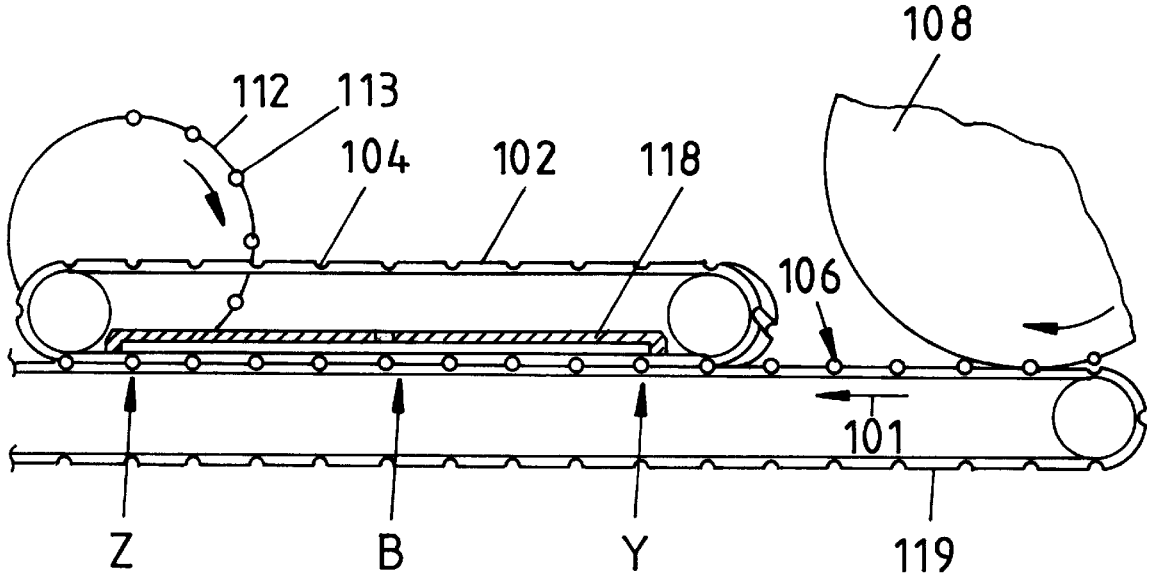
FIG. 3 is a partly elevational and partly longitudinal vertical sectional view of an apparatus constituting a modification of the apparatus which is shown in FIG. 1.
Figure 4:
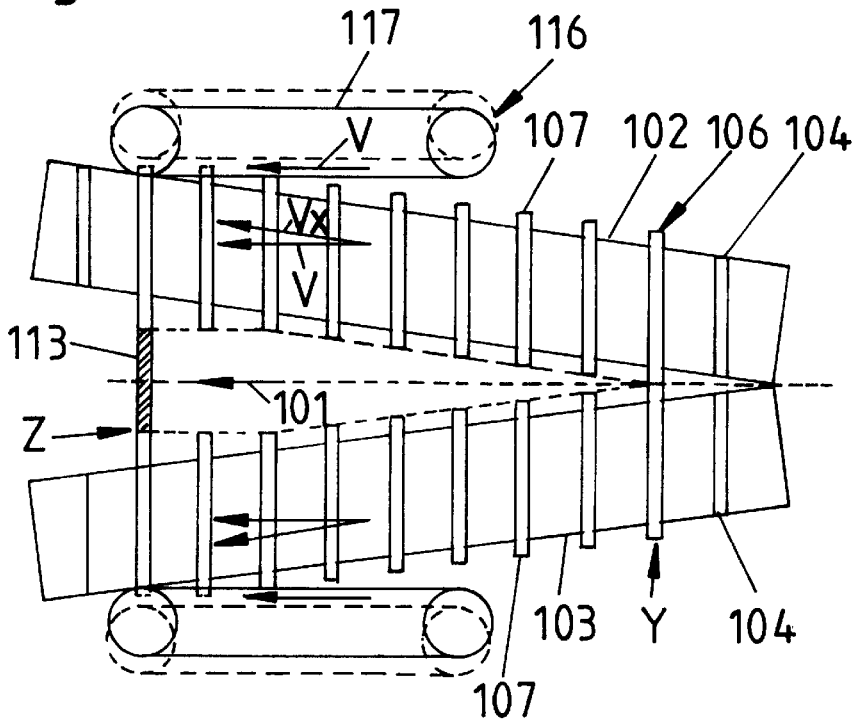
FIG. 4 is a bottom plan view of certain constituents of the modified apparatus, substantially as seen in the direction of arrow B in FIG. 3.

All parts of the apparatus shown in FIGS. 3 and 4 which are identical with or plainly equivalent to those already described with reference to FIGS. 1 and 2 are denoted by similar reference characters plus 100.

The conveyors 102, 103 diverge, as seen in the direction of the arrow 101, in the same way as already described in connection with FIGS. 1–2 and their flutes 104 serve to receive plain cigarettes 107 of unit length of successive pairs 106 delivered by the flutes of the conveyor 108 of the severing means. More specifically, the means for supplying pairs 106 of coaxial articles 107 further comprises an endless flexible belt conveyor 119 having flutes for reception of pairs 106 of articles 107 from the conveyor 108 and for the advancement of such pairs 106 along a horizontal path which is located ahead of but is coplanar with the path defined by the flutes 104 at the undersides of the lower reaches or stretches of the conveyors 102, 103. The transfer of pairs 106 from the conveyor 119 into the flutes 104 at the undersides of the lower reaches of the coveyors 102, 103 takes place at the station Y. The articles 107 are attracted to the surfaces bounding the flutes 104 at the undersides of the lower reaches of the (at least partially foraminous) conveyors 102, 103 by suction (note the suction chamber 118 shown in FIG. 3). The suction chambers 118 terminate at the station Z so that the pairs 106 of axially spaced apart articles 107 come to rest in the flutes of the conveyor 119, and each such flute of the conveyor 119 receives a filter mouthpiece or filter plug 113 of double unit length from the conveyor 112. Thus, each of those flutes of the conveyor 119 which advance beyond the station Z contains a group of three coaxial rod-shaped components including two axially spaced-apart plain cigarettes 107 of unit length and a filter plug 113 of double unit length between them. The functions of the limiting conveyors 117 and adjusting means 116 are the same as those of the parts 16, 17 in the apparatus of FIGS. 1 and 2.

Figure 5:
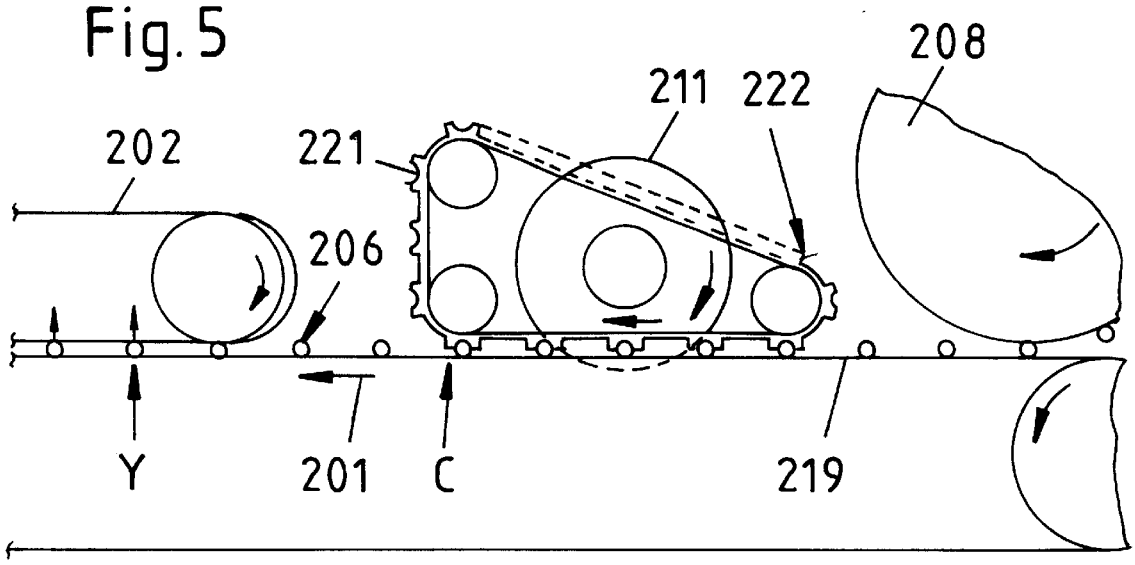
FIG. 5 is an elevational view of a portion of a third apparatus constituting a modification of the apparatus which is illustrated in FIGS. 3 and 4.
Figure 6:
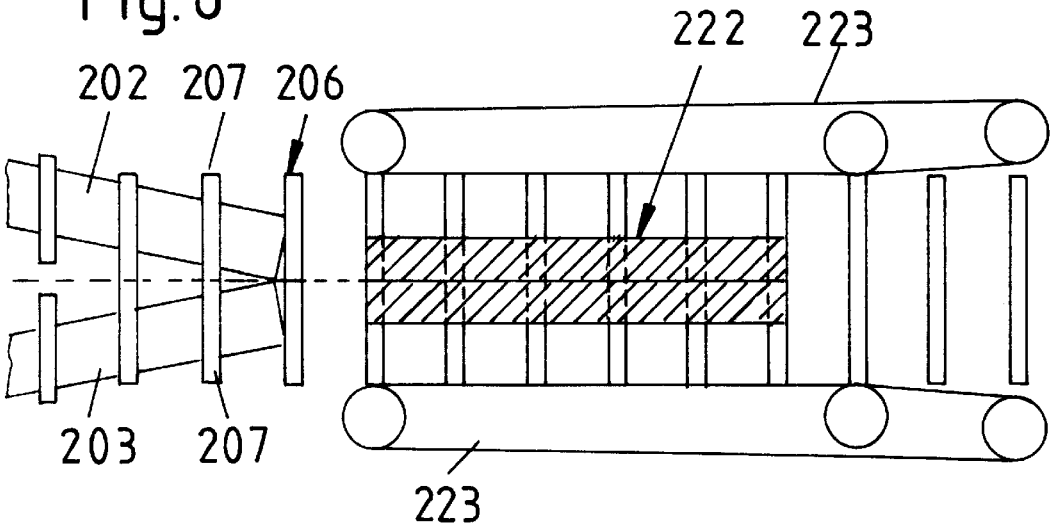
FIG. 6 is a bottom plan view of a portion of the third apparatus as seen in the direction of arrow C.

FIGS. 5 and 6 show certain details of a third apparatus. All such parts which are identical with or clearly analogous to the corresponding parts in the apparatus of FIGS. 3 and 4 are denoted by similar reference characters plus 100. A difference between the apparatus of FIGS. 3–4 and 5–6 is that the commodities which are to yield pairs 206 of coaxial articles 207 are severed by a rotary circular knife 211 while advancing in the flutes at the upper reach of the endless flexible conveyor 219. The apparatus of FIGS. 5–6 further comprises holding means including two endless flexible conveyors 222 with flutes 221 which cooperate with the conveyor 219 to properly bold the commodities in the course of the severing step. The endless belt conveyors 223 of FIG. 6 serve to prevent premature axial movement of neighboring ends of freshly formed pairs 206 of articles 207 axially and away from each other. The conveyors 223 are driven in synchronism with the conveyor 219, i.e., their article-contacting portions advance in the direction of the arrow 201 and at the same speed as the upper reach of the conveyor 219.

Additional belt conveyors (corresponding to the conveyors 17 or 117) are provided adjacent the conveyors 202, 203 of the advancing conveyor which receives pairs 206 of articles 207 from the conveyor 219 (not shown in FIG. 6).

Figure 7:
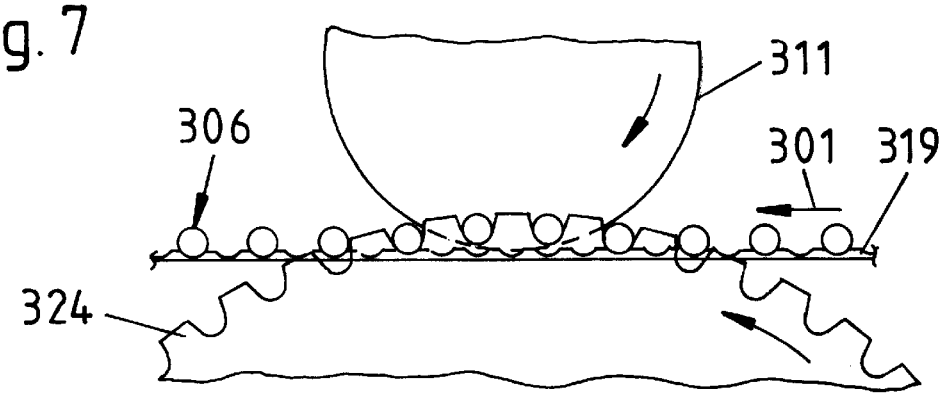
FIG. 7 is a fragmentary elevational view of a further apparatus.

FIG. 7 shows a portion of a fourth apparatus. The endless belt conveyor 319 advances successive commodities in the direction of the arrow 301 into the range of the circular knife 311. The thus obtained pairs 306 are delivered to the advancing conveyor means, e.g., to the station Y in the apparatus of FIGS. 1 and 2. The character 324 denotes a rotary drum having peripheral flutes which at least partially lift the commodities (non-severed pairs of rod-shaped articles) out of the flutes in the upper reach of the conveyor 319 at the severing station.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of the above outlined contribution to the art of manipulating rod-shaped articles and, therefore, such adaptations should and are intended to be comprehended within the meaning and range of equivalence of the appended claims.

What is claimed is:

1. Apparatus for manipulating pairs of coaxial elongated rod-shaped articles of the tobacco processing industry having neighboring ends, comprising means for advancing successive paris of a series of pairs of coaxial articles sideways in a predetermined direction at least substantially at right angles to their common axes, said advancing means comprising means for changing the spacing between said neighboring ends of successive pairs of said series of pairs of coaxial articles during advancement of said pairs in said predetermined direction, said advancing means comprising two endless conveyors having at least substantially coplanar portions defining a predetermined path for moving successive pairs of articles along said predetermined path.

2. Apparatus for manipulating pairs of coaxial elongated rod-shaped articles of the tobacco processing industry having neighboring ends, comprising means for advancing successive paris of a series of pairs of coaxial articles sideways in a predetermined direction at least substantially at right angles to their common axes, said advancing means comprising means for changing the spacing between said neighboring ends of successive pairs of said series of pairs of coaxial articles during advancement of said pairs in said predetermined direction, said advancing means comprising two endless flexible conveyors having at least substantially coplanar portions defining a predetermined path for moving successive pairs of articles along said predetermined path.

3. The apparatus of claim 2, wherein said portions of said endless conveyors are inclined relative to each other and in opposite directions relative to said predetermined direction.

4. The apparatus of claim 3, wherein said portions of said endless conveyors diverge in said predetermined direction.

5. The apparatus of claim 2, wherein said conveyors have receptacles for the respective articles of successive pairs of said series of pairs of articles, the receptacles of each of said conveyors being parallel to each other and to the receptacles of the other of said conveyors.

6. The apparatus of claim 5, wherein said receptacles comprise elongated flutes.

7. The apparatus of claim 2, wherein said portions of said conveyors diverge in said predetermined direction so that the spacing between the neighboring ends of successive pairs of said series of pairs of coaxial articles increases as a result of advancement of articles in said predetermined direction, and further comprising means for limiting the extent or spacing between the neighboring ends of successive pairs of said series of pairs of coaxial articles.

8. The apparatus of claim 7, wherein said limiting means comprises a pair of endless flexible conveyors arranged to advance in said predetermined direction in synchronism with said portions of said endless conveyors of said advancing means, said endless flexible conveyors of said limiting means flanking said portions of said conveyors of said advancing means.

9. The apparatus of claim 8, wherein said predetermined path is an at least substantially horizontal path and said endless flexible conveyors of said limiting means have at least substantially vertical article-contacting portions.

10. The apparatus of claim 8, wherein at least one of said endless flexible conveyors of said limiting means is adjustable relative to said advancing means transversely of said predetermined direction.

11. The apparatus of claim 2, wherein said conveyors have upper and lower reaches, said upper reaches constituting said path-defining portions of the respective conveyors and the articles being arranged to overlie the respective upper reaches during advancement in said predetermined direction.

12. The apparatus of claim 2, wherein said conveyors have upper and lower reaches, said lower reaches constituting said path-defining portions of the respective conveyors and said lower reaches being arranged to overlie the respective articles during advancement of articles along said predetermined path.

13. The apparatus of claim 12, wherein said conveyors include means for attracting articles to said lower reaches of the respective conveyors.

14. The apparatus of claim 2, further comprising means for supplying a series of successive elongated rod-shaped commodities to said advancing means sideways along a second path, and means for subdividing successive commodities of said series of commodities into pairs of coaxial rod-shaped articles not later than upon arrival of successive commodities at said predetermined path.

15. The apparatus of claim 14, wherein said supplying means comprises an endless flexible conveyor.

16. The apparatus of claim 15, wherein said endless flexible conveyor of said supplying means is arranged to advance in said predetermined direction at a predetermined speed, and further comprising means for form-lockingly holding the commodities on said conveyor of said supplying means during subdividing of such commodities.

17. The apparatus of claim 16, wherein said holding means includes at least one endless conveyor arranged to move in synchronism with said conveyor of said supplying means.

18. The apparatus of claim 15, wherein said conveyor of said supplying means has receptacles for the advancement of commodities in said predetermined direction, and further comprising means for moving successive commodities of said series of commodities out of the respective receptacles during conversion of such commodities into pairs of coaxial articles by said subdividing means.

19. The apparatus of claim 18, wherein said receptacles have flutes and said means for moving successive commodities out of said flutes comprises a rotary drum arranged to lift the commodities at least partially out of the respective flutes.

* * * * *